US010612337B2

(12) United States Patent
Dursley

(10) Patent No.: US 10,612,337 B2
(45) Date of Patent: Apr. 7, 2020

(54) SACRIFICIAL BREAKAWAY MECHANISM

(71) Applicant: GE Oil & Gas UK LImited, Nailsea Bristol (GB)

(72) Inventor: Paul Dursley, Nailsea Bristol (GB)

( * ) Notice: Subject to any disclaimer, the term of this patent is extended or adjusted under 35 U.S.C. 154(b) by 0 days.

(21) Appl. No.: 15/745,509

(22) PCT Filed: Jul. 19, 2016

(86) PCT No.: PCT/EP2016/067191
§ 371 (c)(1),
(2) Date: Jan. 17, 2018

(87) PCT Pub. No.: WO2017/016936
PCT Pub. Date: Feb. 2, 2017

(65) Prior Publication Data

US 2018/0216433 A1 Aug. 2, 2018

(30) Foreign Application Priority Data

Jul. 24, 2015 (GB) ..... 1513066.9

(51) Int. Cl.
*E21B 33/038* (2006.01)
*E21B 29/12* (2006.01)
*E21B 33/035* (2006.01)

(52) U.S. Cl.
CPC ..... *E21B 33/038* (2013.01); *E21B 29/12* (2013.01); *E21B 33/0355* (2013.01); *E21B 33/0385* (2013.01)

(58) Field of Classification Search
CPC .... E21B 29/12; E21B 33/0355; E21B 33/038; E21B 33/0385
See application file for complete search history.

(56) References Cited

U.S. PATENT DOCUMENTS 3,882,748 A * 5/1975 Moore ..... B23D 23/00 114/221 A
4,653,776 A * 3/1987 Borg ..... F16L 55/00 166/363

(Continued)

FOREIGN PATENT DOCUMENTS

WO 00/01922 A1 1/2000
WO 00/26496 A1 5/2000

(Continued)

OTHER PUBLICATIONS

"Pressure Balanced Weak Links," KONGSBERG, Retrieved from the Internet URL:https://web.archive.org/ web/20161012030114/ http://www.kongsberg.com:80/en/kogt/products%20and%20services/ subsea%20products% 20and%20systems/pressure%20balanced% 20weak%20links/, pp. 1-2 (2015).

(Continued)

*Primary Examiner* — James G Sayre

(57) ABSTRACT

A sacrificial breakaway mechanism comprising: a first piece attached to a fixed structure; a second piece; a plurality of connectors running between the second piece and the fixed structure; and a sacrificial element connecting the first piece to the second piece, wherein the sacrificial element is configured such that a tensile load exceeding a predetermined threshold exerted on the second piece causes the sacrificial element to break, separating the first piece from the second piece and allowing relative movement therebetween, the relative movement causing a sequential disconnection of the plurality of connectors.

32 Claims, 6 Drawing Sheets

(56) References Cited

U.S. PATENT DOCUMENTS

| | | | | |
|---|---|---|---|---|
| 5,177,317 | A * | 1/1993 | Walker | B23D 15/145 114/221 A |
| 5,269,565 | A | 12/1993 | Langner | |
| 6,102,124 | A | 8/2000 | Skeels et al. | |
| 6,397,948 | B1 * | 6/2002 | Williams | E21B 43/017 166/363 |
| 6,526,858 | B1 * | 3/2003 | Smith | B26D 1/02 166/54.5 |
| 6,561,714 | B1 * | 5/2003 | Williams | F16L 23/036 166/364 |
| 6,789,627 | B2 * | 9/2004 | Leismer | E21B 29/04 166/117 |
| 7,631,608 | B1 * | 12/2009 | Lombardi | B63C 11/52 114/221 A |
| 2011/0284237 | A1 | 11/2011 | Baugh | |

FOREIGN PATENT DOCUMENTS

| | | | |
|---|---|---|---|
| WO | 2013/071983 | A1 | 5/2013 |
| WO | 2014/206831 | A1 | 12/2014 |

OTHER PUBLICATIONS

August, C., et al., "Improved Integrity & Reliability for Subsea Hydraulic Multi-Quick Connections," Offshore Mediterranean Conference and Exhibition, Retrieved from the Internet URL: https://www.onepetro.org/conference-paper/OMC-2013-050, pp. 1-2 (2013) (Abstract).

Gruyaert et al., "Umbilical systems," Engineering and technologies, Retrieved from the Internet URL:http://www. technip.com/sites/default/files/technip/publications/attachments/Umbilical_Systems.pdf, pp. 1-20 (Jul. 2011).

Search Report issued in connection with corresponding GB Application No. 1513066.9 dated Jan. 26, 2016.

International Search Report and Written Opinion issued in connection with corresponding PCT Application No. PCT/EP2016/067191 dated Nov. 3, 2016.

International Preliminary Report on Patentabilty issued in connection with corresponding PCT Application No. PCT/EP2016/067191 dated Jan. 30, 2018.

* cited by examiner

SACRIFICIAL BREAKAWAY MECHANISM

TECHNICAL FIELD

This invention relates to a sacrificial breakaway mechanism and a method of sequentially disconnecting connectors. In one embodiment, it relates to a sacrificial breakaway mechanism for a subsea jumper system.

BACKGROUND

In subsea hydrocarbon extraction facilities, there is a requirement to limit the amount of force exerted on subsea structures. In particular, where connectors, such as flying leads (i.e. subsea jumper systems providing interconnections within a subsea development), are connected to multiple quick connection (MQC) plates on a subsea structure there is the possibility that a jumper containing the flying lead may become snagged, for example, by anchors or trawl boards, and a tensile force exerted on the jumper that is transmitted to, and causes damage to, the subsea structure. It is therefore prudent to install a sacrificial breakaway system which can limit the amount of force that may be exerted on a subsea structure through a jumper.

Such systems are known. These comprise breakaway mechanisms that disconnect all of the flying leads in the jumper simultaneously. An example would be a mechanism comprising a pair of MQC plates populated with male and female connectors and held to one another using a hydraulic release unit. If a jumper connected to one of the MQC plates is pulled with a force exceeding a predetermined limit, the hydraulic release unit will release the two MQC plates. However, all the connectors between the MQC plates will be disconnected simultaneously.

This type of known system has problems, e.g. it could cause problems in subsea hydrocarbon extraction facilities as unless a sequential shutdown order of components in the facility is followed, damage can be caused to well components (e.g. a downhole safety valve).

It is an aim of the present invention to overcome some of the problems associated with prior art sacrificial breakaway systems by providing a sacrificial breakaway system which allows for a controlled shutdown of well components by disconnecting connectors in a preselected sequence during breakaway.

SUMMARY OF THE INVENTION

In accordance with one aspect of the present invention there is provided a sacrificial breakaway mechanism comprising:

a. a first piece attached to a fixed structure;

b. a second piece;

c. a plurality of connectors running between the second piece and the fixed structure; and d. a sacrificial element connecting the first piece to the second piece, wherein said sacrificial element is configured such that a tensile load exceeding a predetermined threshold exerted on the second piece causes the sacrificial element to break, separating the first piece from the second piece and allowing relative movement therebetween, said relative movement causing a sequential disconnection of the plurality of connectors.

In accordance with another aspect of the present invention there is provided a method of sequentially disconnecting a plurality of connectors comprising the steps of:

a. providing a sacrificial breakaway mechanism comprising:

i. a first piece attached to a fixed structure;

ii. a second piece, the plurality of connectors running between the second piece and the fixed structure; and iii. a sacrificial element connecting the first piece to the second piece, wherein said sacrificial element is configured such that a tensile load exceeding a predetermined threshold exerted on the second piece causes the sacrificial element to break, b. exerting a tensile load exceeding the predetermined threshold on the second piece;

c. separating the first piece from the second piece and causing relative movement therebetween; and d. using said relative movement to cause a sequential disconnection of the plurality of connectors.

The sacrificial element could be a shear pin.

The breakaway mechanism could further comprise a shearing mechanism, said shearing mechanism sequentially severing the connectors in sequence during the relative movement. The shearing mechanism could comprise a blade attached to one of the first piece and the second piece. The shearing mechanism could comprise a through-plate attached to the other of the first piece and the second piece. The through-plate could comprise a plurality of apertures which receive the plurality of connectors.

The plurality of connectors could vary in length, the relative movement acting to disconnect the plurality of connectors in order from shortest to longest.

The plurality of connectors could comprise respective tubes containing respective hydraulic lines. At least one of the hydraulic lines could be a low pressure hydraulic line and at least one of the hydraulic lines could be a high pressure hydraulic line. The sequential disconnection of the plurality of connectors could comprise severing the at least one low pressure hydraulic line before the at least one high pressure hydraulic line.

The plurality of connectors could comprise an electrical line.

The fixed structure could be a subsea structure. The first piece could be attached to the subsea structure via a multiple quick connection plate. The second piece could be attached to a tube bundle via a termination flange. The second piece could be attached to a mini umbilical via a termination flange.

In one embodiment, the invention comprises a subsea hydrocarbon extraction facility including a sacrificial breakaway mechanism as described above.

BRIEF DESCRIPTION OF THE DRAWINGS

The invention will now be described with reference to the accompanying drawing, in which.

DETAILED DESCRIPTION

Figure 1:
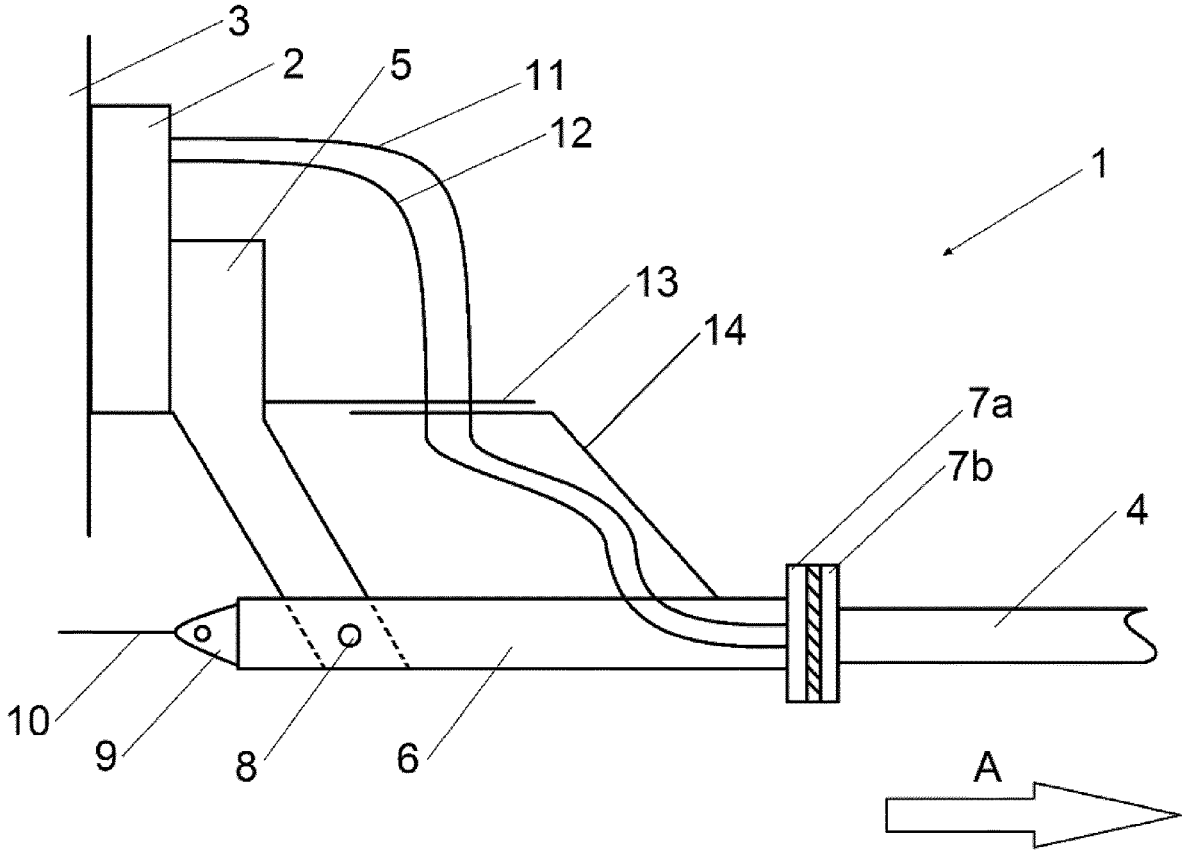
FIG. 1 schematically shows a sacrificial breakaway mechanism according to an embodiment of the invention during installation.

A sacrificial breakaway mechanism 1 according to an embodiment of the invention is schematically shown during installation in FIG. 1. The sacrificial breakaway mechanism 1 links a multiple quick connection (MQC) plate 2, mounted to a subsea structure 3, to a tube bundle 4.

The sacrificial breakaway mechanism 1 comprises a first piece 5 attached to the MQC plate 2 and a second piece 6 attached to the tube bundle 4 via a termination flange 7*a*, 7*b*. The second piece 6 carries a first half 7*a* of the termination flange and the tube bundle 4 carries a second half 7*b* of the termination flange. The two halves 7*a*, 7*b* are mechanically interfaced with one another. The first piece 5 and second piece 6 are connected to one another via a sacrificial element in the form of a shear pin 8. The shear pin 8 is configured such that a tensile load exceeding a predetermined threshold exerted on the second piece will causes the shear pin 8 to break.

The second piece 6 is also anchored to a subsea anchor point, such as a concrete block (not shown) located on the seabed, via a connector 9 and cable 10 during installation. This is important, as during installation loads of several tonnes may be imparted on the components of the sacrificial breakaway mechanism 1, particularly on the second piece 6 along a load path in the direction of arrow A. By anchoring the second piece 6 to an anchor point, these installation loads may be transmitted directly to the anchor point and prevent the shear pin 8 from fracturing prematurely.

A pair of tubes 11, 12 run between the MQC plate 2 and the second piece 6, running through the termination flange 7*a*, 7*b*. The first tube 12 carries a low pressure hydraulic line and the second tube 11 carries a high pressure hydraulic line.

The tubes 11, 12 run through a shearing mechanism 13, 14. The shearing mechanism comprises a through-plate 13 connected to the first piece 5 and a blade 14 attached to the second piece 6. The through-plate 13 comprises a plurality of apertures through which the tubes 11, 12 run in use. The blade 14 is capable of severing the tubes 11, 12 when laterally forced against them.

Figure 2:
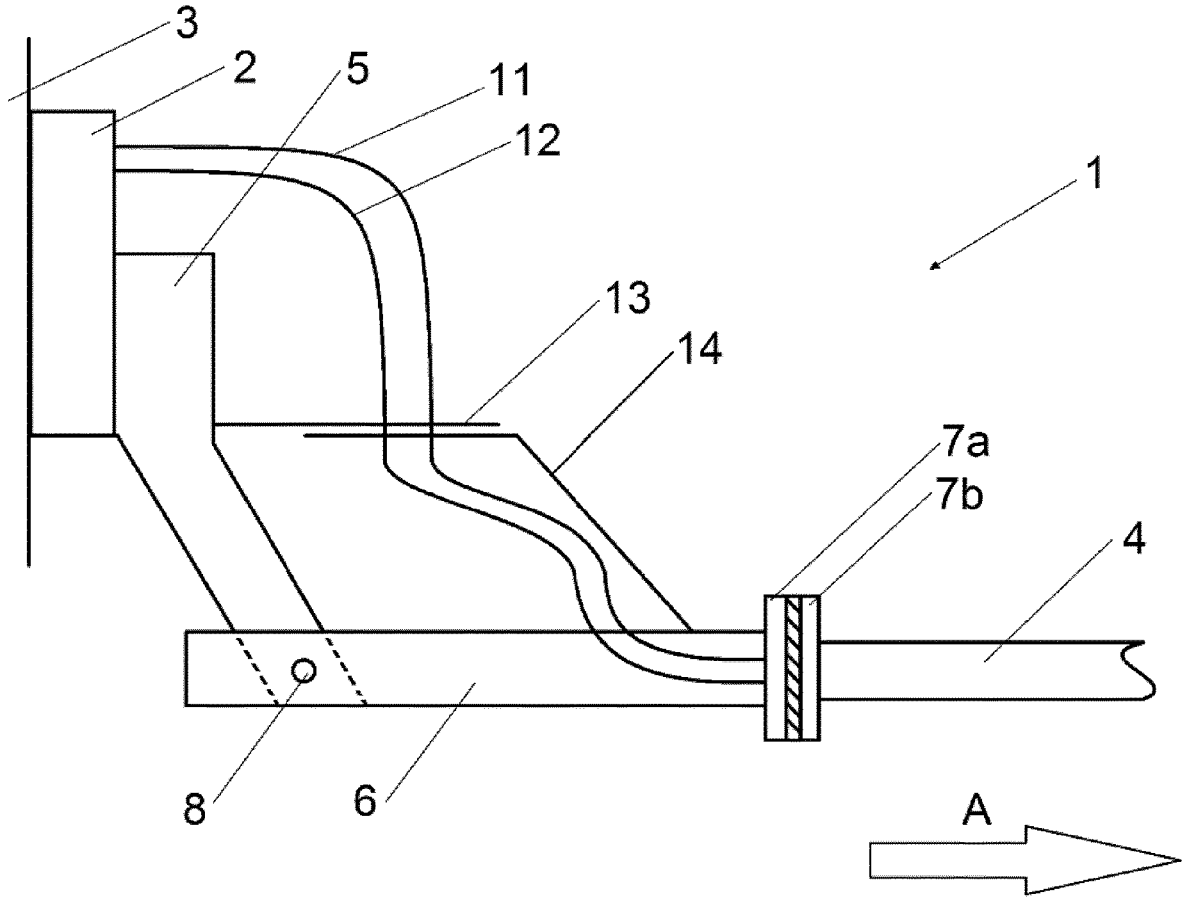
FIG. 2 schematically shows the sacrificial breakaway mechanism of FIG. 1 after installation.

FIG. 2 shows the sacrificial breakaway mechanism 1 of FIG. 1 after installation has been completed. The connector 9 and cable 10 have been removed, and so forces imparted on the tube bundle 4 are transmitted to the shear pin 8. In practice, the connector 9 could remain attached to the second piece 6, for example if the connector 9 were to be a lifting padeye welded to the second piece 6, and this would not inhibit the operation of an embodiment of the invention provided the cable 10 was removed.

When a tensile force is exerted on the tube bundle 4 (e.g. a force in the direction of arrow A) which exceeds a predetermined threshold, the shear pin 8 breaks, allowing the second piece 6 to move relative to the first piece 5. The movement of the second piece 6 will be rightward with respect to the first piece 5 as depicted in FIG. 1.

The relative movement between the first piece 5 and the second piece 6 also causes relative movement between the components of the shearing mechanism 13, 14. The tubes 11, 12 are held in place by the through-plate 13 and the blade 14 is forced laterally against the tubes, severing them sequentially.

Figure 3:
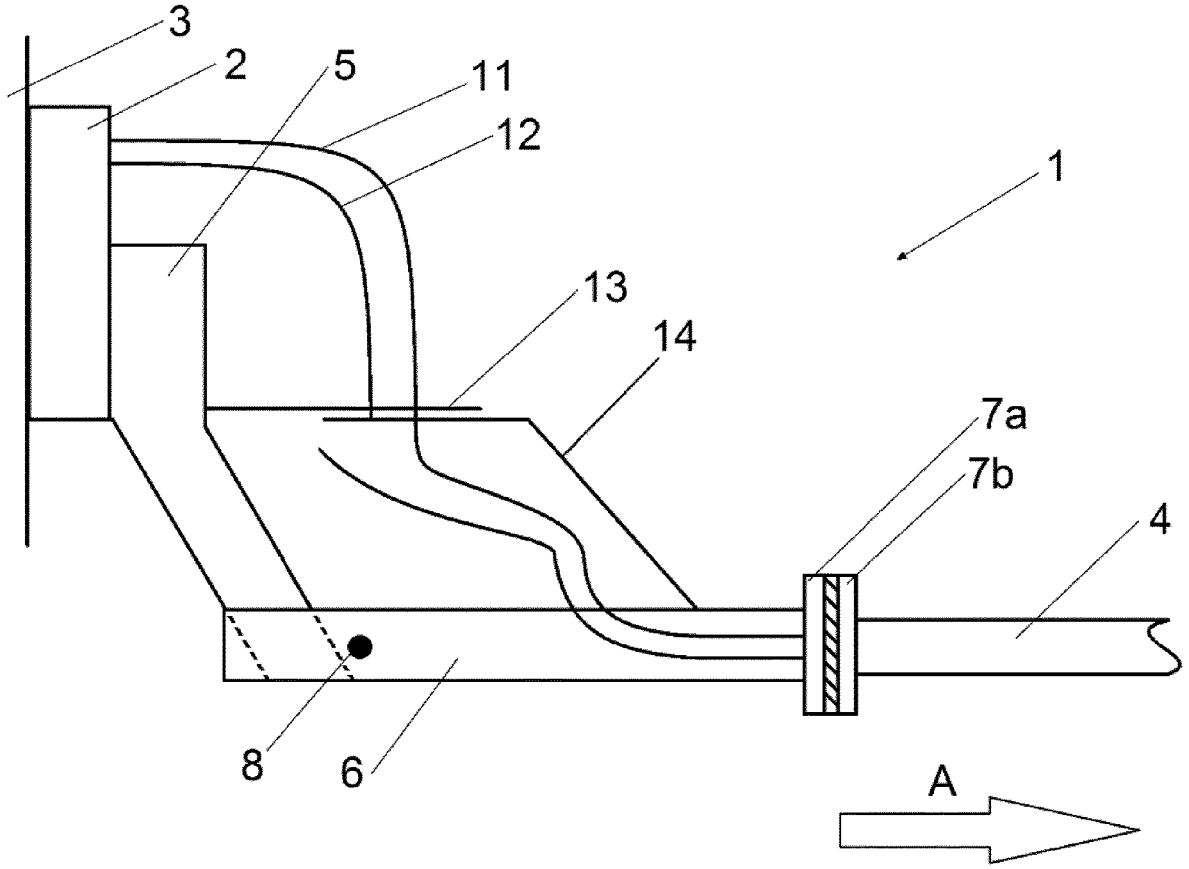
FIG. 3 schematically shows the sacrificial breakaway mechanism of FIG. 1 during operation.

FIG. 3 shows the sacrificial breakaway mechanism 1 of FIG. 1 during operation, where a force exceeding a predetermined threshold has been applied to the tube bundle 4 in the direction of arrow A. The shear pin 8 has fractured, allowing the second piece 6 to move a small amount relative to the first piece 5 in the direction of arrow A. By virtue of the relative movement, the blade 14 has been forced laterally against the first tube 12 and has severed it. At the stage of operation depicted in FIG. 3, the second tube 11 is still intact and continues to connect the MQC plate 2 with the second piece 6. Components, for example in a subsea well connected to the subsea structure 3, using the hydraulic fluid provided by the first tube 12 have ceased to function. Components, for example in a subsea well connected to the subsea structure 3, using the hydraulic fluid provided by the second tube 11 continue to function.

Figure 4:
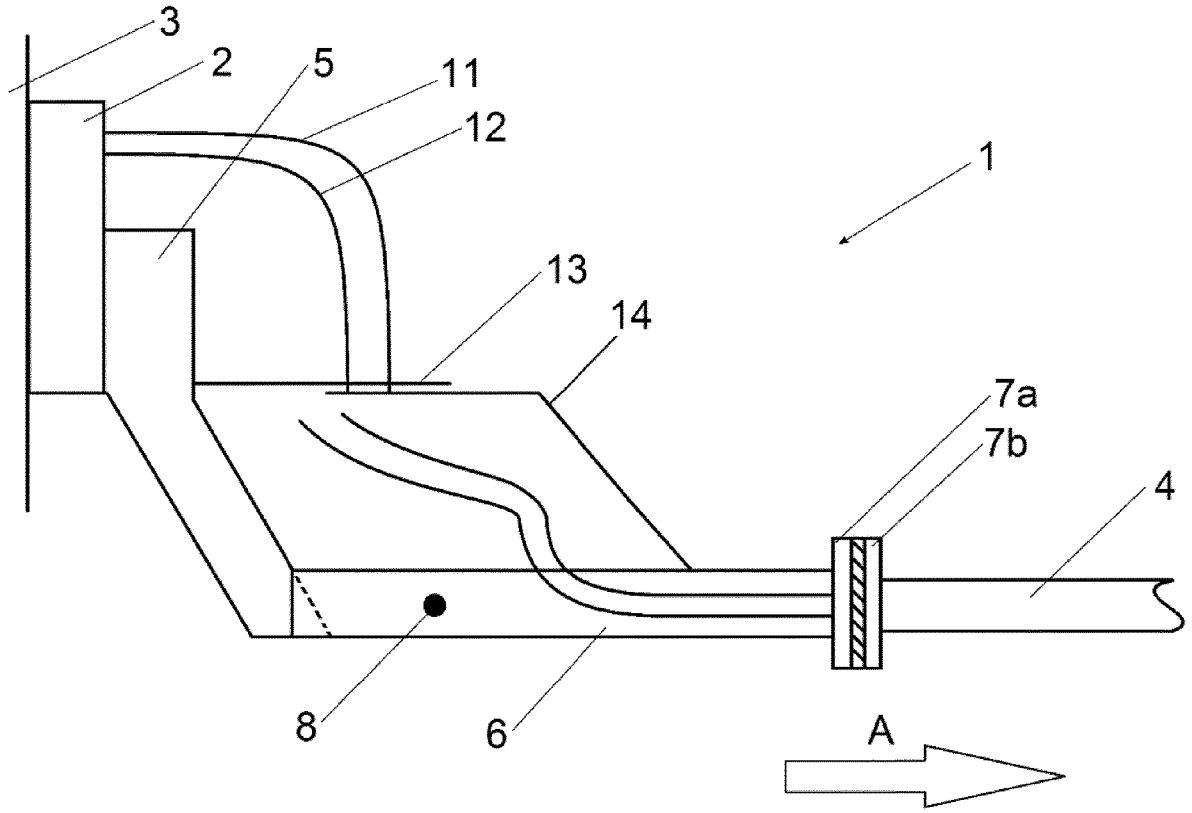
FIG. 4 schematically shows the sacrificial breakaway mechanism of FIG. 1 at a later time during operation than that shown in FIG. 3.

FIG. 4 also shows the sacrificial breakaway mechanism of FIG. 1 during operation, where a force exceeding a predetermined threshold has been applied to the tube bundle 4 in the direction of arrow A. The shear pin 8 has fractured, allowing the second piece 6 to move a small amount relative to the first piece 5 in the direction of arrow A. FIG. 4 shows the sacrificial breakaway mechanism 1 at a later time during operation from that shown in FIG. 3.

As FIG. 4 shows the sacrificial breakaway mechanism 1 at a later time than FIG. 3, and a force continues to be applied on the tube bundle 4 in the direction of arrow A, the second piece 6 has moved further relative to the first piece 5. By virtue of this further relative movement, the blade 14 has been forced laterally against the second tube 11 and has severed it. Components, for example in a subsea well connected to the subsea structure 3, using the hydraulic fluid provided by the second tube 11 have ceased to function. The sequential severing of the tubes 11, 12 allows for a controlled shutdown of a subsea well connected to the subsea structure 3.

Figure 5:
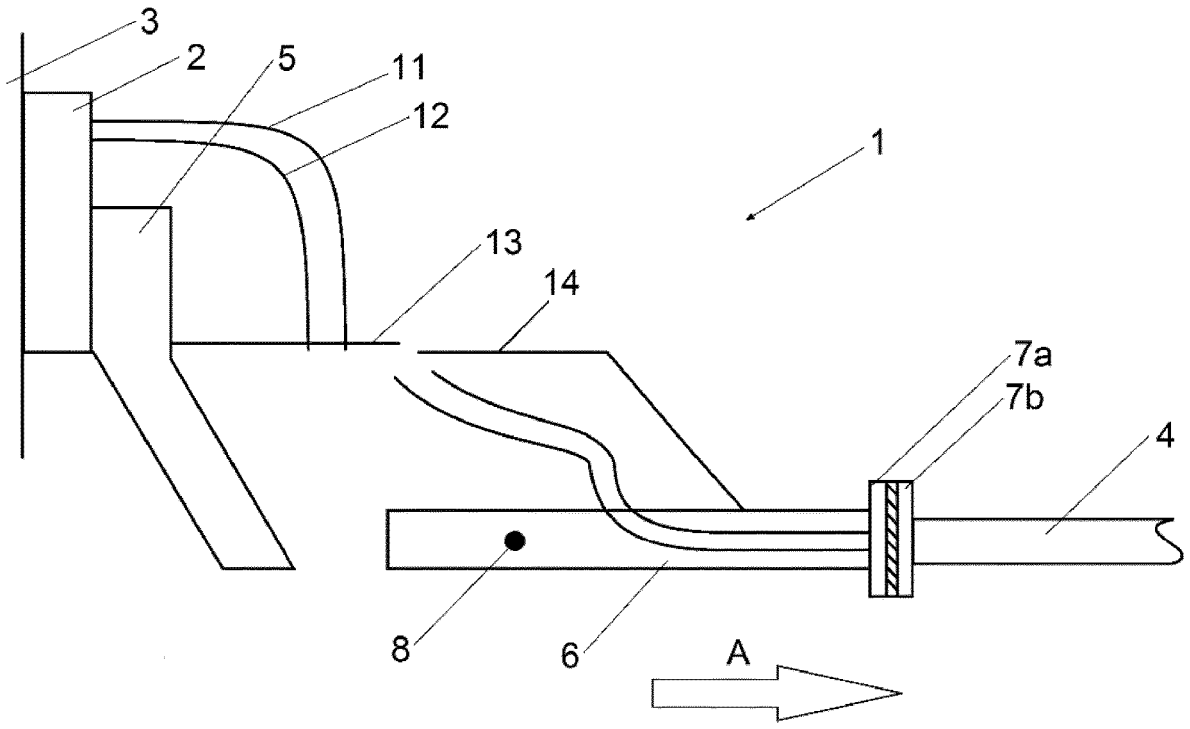
FIG. 5 schematically shows the sacrificial breakaway mechanism of FIG. 1 at a later time during operation than that shown in FIG. 4.

FIG. 5 shows the sacrificial breakaway mechanism 1 at a later time than FIG. 4. A force continues to be applied on the tube bundle 4 in the direction of arrow A, and so the second piece 6 has moved even further relative to the first piece 5. FIG. 5 clearly shows that all of the components 2, 3, 5, 11, 12 and 13 are now completely separated from components 4, 6, 7*a*, 7*b*, 8 and 14.

Figure 6:
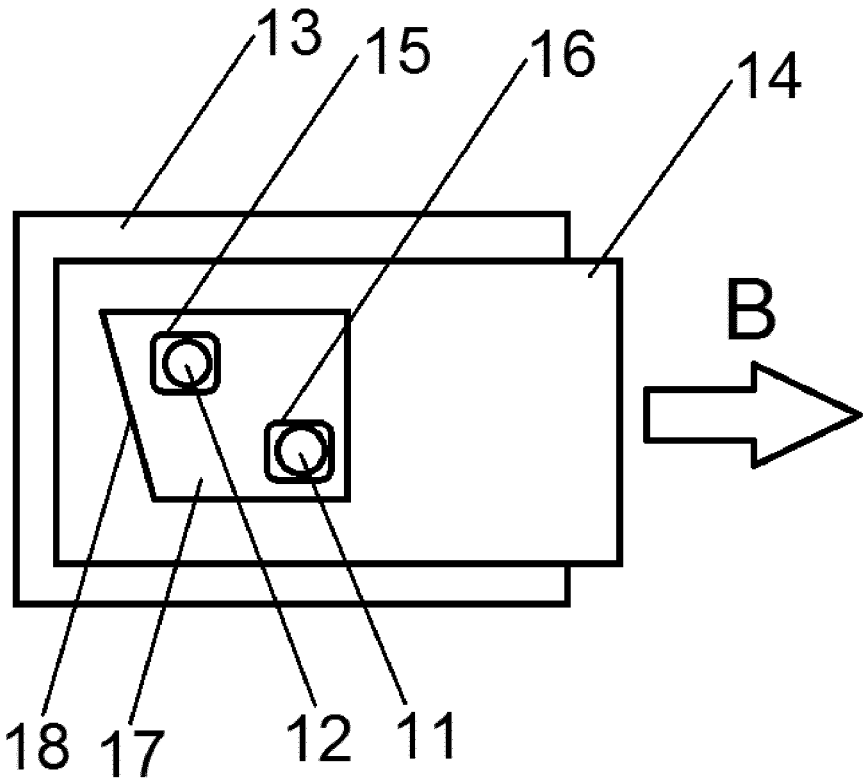
FIG. 6 schematically shows a view of the shearing mechanism of FIG. 2 from beneath.

FIG. 6 schematically shows a view of the shearing mechanism 13, 14 of FIG. 2 from beneath. The through-plate 13 comprises a first aperture 15 and a second aperture 16, spaced laterally from the first aperture 15, through which the first tube 12 and second tube 11 run respectively.

The blade 14 comprises a window 17 though which both the first tube 12 and second tube 11 run. The window 17 has an angled section 18 which is sharpened. It is the angled section 18 which is used to sever the tubes 11, 12 during operation of the sacrificial breakaway mechanism 1. As can be seen, when the blade 14 is moved in the direction of arrow B (which correspond to the direction of arrow A in FIGS. 1-5) the angled section 18 of the blade 14 will firstly contact the first tube 12. The first tube 12 will be trapped between an edge of the aperture 15 and the angled section 18, and so will be severed by the angled section 18 if a sufficient force is applied to the blade 14. As the blade 14 moves further in the direction of arrow B, the angled section 18 will subsequently contact the second tube 11. The second tube 11 will be trapped between an edge of the aperture 16 and the angled section 18, and so will be severed by the angled section 18 if a sufficient force is applied to the blade 14.

While the second piece 6 is attached to a tube bundle 4 in the above described embodiment, it could alternatively be attached to a mini umbilical, i.e. a smaller version of an umbilical cable with a smaller number of control lines running through it. Typically, mini umbillicals have a greater length than tube bundles such as flying leads (which are usually limited to approximately 300 m or less) and terminate in a 'Cobra Head' termination, which the sacrificial breakaway mechanism of an embodiment of the present invention may replace.

The tubes 12, 13 shown the embodiment above carry hydraulic lines, but embodiments of the invention is not limited to tubes. Electrical lines, fibre optic lines, or any other suitable connector could also be used.

While a shearing mechanism comprising a blade is described above, the connectors running between the structure and the second piece need not be severed, but simply disconnected. For example, the connectors desired to be disconnected first in the sequence may be designed to be shorter in length than those desired to be disconnected later in the sequence, such that the relative movement between the first and second pieces causes the shorter connectors to be disconnected before the longer connectors.

Embodiments of the invention aim to provide one or more of the following benefits over the prior art:

i) The sacrificial breakaway mechanism limits accidental loads transmitted to a subsea structure.

ii) The design may be incorporated into the existing envelope for subsea termination heads.

iii) The sacrificial breakaway mechanism does not introduce any new leak paths in a subsea distribution network.

iv) The arrangement of the first piece is not in line with the installation load path and so installation forces do not cause the sacrificial breakaway mechanism to prematurely fail.

v) The sacrificial breakaway mechanism provides a controlled sequence of hydraulic line failure (e.g. low pressure lines disconnected before high pressure lines) for controlled equipment shut down. In a typical subsea well, low pressure lines are used to operate primary operational well control valves. These valves are located at the seabed, incorporated into the Christmas tree. High pressure lines are typically used to operate one or more downhole safety valve, i.e. a valve used to shut the production bore at a distance below the seabed. The downhole safety valve's primary function is to shut in well flow in the case of a significant emergency. However, if the downhole safety valve carries out this function it may not be able to re-open without significant external intervention into the wellbore itself. This can be time-consuming and costly. The shutdown sequencing provided by the present invention ensures that primary well flow control valves (operated by low pressure lines) are used to shut down well flow before the down hole safety valve is activated, thereby minimising any risk that it may not be able to re-open again at a later time without intervention.

vi) The sacrificial breakaway mechanism mitigates the costs associated with the recovery of damaged subsea structures.

vii) Reduces the time and cost associated with bringing damaged equipment back on line.

viii) Damaged equipment can be repaired using offshore support vessels of lesser capacity, thereby increasing the available pool of vessels suitable for this type of intervention.

The invention is not limited to the specific embodiments disclosed above, and other possibilities will be apparent to those skilled in the art. For example, while two connectors are shown in FIGS. 1-5 the invention is not so limited, and additional connectors may be employed. Additionally, while the invention is described with reference to FIGS. 1-5 with a tube bundle as item 4, this could be replaced with, for example, a bundle thermoplastic hoses, electrical connectors, fibre optic cables or any other suitable connector. While a guillotine-type shearing mechanism is described in the above embodiment, the invention is not limited to this, and it may be substituted with any shearing mechanism which uses the relative motion of the first and second pieces to effect the sequential disconnection of the connectors.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

The invention claimed is:

1. A sacrificial breakaway mechanism comprising:
- a first piece attached to a fixed structure;
- a second piece attached to a connector bundle;
- a plurality of connectors running between the second piece and the fixed structure;
- a sacrificial element attaching directly the first piece to the second piece
- a cable connector coupled to the second piece; and
- a cable extending between the cable connector and an anchor point, the cable securing the second piece into position during installation to prevent premature breaking of the sacrificial element, wherein
  - said sacrificial element is configured such that a tensile load exceeding a predetermined threshold exerted on the second piece, after installation, causes the sacrificial element to break, separating the first piece from the second piece and allowing relative movement therebetween, and
  - said relative movement causing a sequential disconnection of the plurality of connectors for a controlled shutdown of components connected to the connector bundle by disconnecting connectors in a preselected sequence during the relative movement.

2. The sacrificial breakaway mechanism according to claim 1, wherein the sacrificial element is a shear pin.

3. The sacrificial breakaway mechanism according to claim 1, further comprising a shearing mechanism configured to sequentially sever the connectors in sequence during the relative movement.

4. The sacrificial breakaway mechanism according to claim 3, wherein the shearing mechanism comprises a first through-plate having a blade attached to one of the first piece and the second piece.

5. The sacrificial breakaway mechanism according to claim 4, wherein the shearing mechanism comprises a second through-plate attached to the other of the first piece and the second piece, the second through-plate comprising a plurality of apertures which receive a respective connector of the plurality of connectors.

6. The sacrificial breakaway mechanism according to claim 5, wherein the first through-plate comprises an opening which receives the plurality of connecters passing through the second through-plate.

7. The sacrificial breakaway mechanism according to claim 1, wherein the plurality of connectors varies in length, the relative movement acting to disconnect by pulling the plurality of connectors in order from shortest to longest.

8. The sacrificial breakaway mechanism according to claim 7, wherein the sequential disconnection of the plurality of connectors comprises disconnecting at least one low pressure hydraulic line before at least one high pressure hydraulic line.

9. The sacrificial breakaway mechanism according to claim 1, wherein the plurality of connectors comprises respective tubes containing respective hydraulic lines.

10. The sacrificial breakaway mechanism according to claim 9, wherein at least one of the hydraulic lines is a low pressure hydraulic line and at least one of the hydraulic lines is a high pressure hydraulic line, and wherein the relative movement acting to disconnect the one low pressure hydraulic line and then disconnects the low pressure line before the one high pressure hydraulic line.

11. The sacrificial breakaway mechanism according to claim 1, wherein the plurality of connectors comprises an electrical line.

12. The sacrificial breakaway mechanism according to claim 1, wherein the fixed structure is a subsea structure.

13. The sacrificial breakaway mechanism according to claim 12, wherein the first piece is attached to the subsea structure via a multiple quick connection plate.

14. The sacrificial breakaway mechanism according to claim 12, wherein the second piece is attached to a tube bundle via a termination flange.

15. The sacrificial breakaway mechanism according to claim 12, wherein the second piece is attached to a mini umbilical via a termination flange.

16. A method of sequentially disconnecting a plurality of connectors, the method comprising:

providing a sacrificial breakaway mechanism comprising:

a first piece attached to a fixed structure;

a second piece attached to a connector bundle, the plurality of connectors running between the second piece and the fixed structure;

a sacrificial element attaching directly the first piece to the second piece, wherein said sacrificial element is configured such that a tensile load exceeding a predetermined threshold exerted on the second piece causes the sacrificial element to break; and a cable connector coupled to the second piece;

installing the sacrificial breakaway mechanism at an anchor point, the second piece being coupled to the anchor point via a cable extending between the anchor point and the cable connector;

exerting a tensile load, after removal of the cable, exceeding the predetermined threshold on the sacrificial element;

separating the first piece from the second piece and causing relative movement therebetween; and using said relative movement to cause a sequential disconnection of the plurality of connectors for a controlled shutdown of components connected to the connector bundle by disconnecting connectors in a preselected sequence during the relative movement.

17. The method according to claim 16, wherein the sacrificial element is a shear pin.

18. The method according to claim 16, wherein the separating the first piece and the second piece comprise sequentially severing the connectors in sequence during the relative movement.

19. The method according to claim 18, wherein the sequential severing is performed by a shearing mechanism comprising a first-through plate having a blade attached to one of the first piece and the second piece.

20. The method according to claim 19, wherein the shearing mechanism comprises a second through-plate attached to the other of the first piece and the second piece, the second through-plate comprising a plurality of apertures which receive a respective connector of the plurality of connectors.

21. The method according to claim 20, wherein the first through-plate comprising an opening which receives the plurality of connecters passing through the second through-plate.

22. The method according to claim 16, wherein the plurality of connectors varies in length, the relative movement acting to disconnect by pulling the plurality of connectors in order from shortest to longest.

23. The method according to claim 22, wherein the sequential disconnection of the plurality of connectors comprises disconnecting at least one low pressure hydraulic line before at least one high pressure hydraulic line.

24. The method according to claim 16, wherein the plurality of connectors comprises respective tubes containing respective hydraulic lines.

25. The method according to claim 24, wherein at least one of the hydraulic lines is a low pressure hydraulic line and at least one of the hydraulic lines is a high pressure hydraulic line, and wherein the relative movement acting to disconnect the one low pressure hydraulic line and then disconnects the low pressure line before the one high pressure hydraulic line.

26. The method according to claim 16, wherein the plurality of connectors comprises an electrical line.

27. The method according to claim 16, wherein the fixed structure is a subsea structure.

28. The method according to claim 27, wherein the first piece is attached to the subsea structure via a multiple quick connection plate.

29. The method according to claim 27, wherein the second piece is attached to a tube bundle via a termination flange.

30. The method according to claim 27, wherein the second piece is attached to a mini umbilical via a termination flange.

31. The method according to claim 16 performed in a subsea hydrocarbon extraction facility.

32. A sacrificial breakaway mechanism comprising:

a first piece attached to a fixed structure;

a second piece attached to a connector bundle;

a plurality of connectors running between the second piece and the fixed structure;

a sacrificial element attaching the first piece to the second piece;

a cable connector coupled to the second piece;

a cable extending between the cable connector and an anchor point, the cable securing the second piece into position during installation to prevent premature breaking of the sacrificial element; and a shearing element comprising:

a first through-plate attached to one of the first piece and the second piece, the first through-plate comprising a plurality of apertures which receive a respective connector of the plurality of connectors; and a second through-plate blade attached to the other of the first piece and the second piece, the second through-plate comprising a blade and an opening which receives the plurality of connecters passing through the first through-plate;

wherein the sacrificial element is configured such that a tensile load exceeding a predetermined threshold exerted on the second piece causes the sacrificial element to break, separating the first piece from the second piece and allowing relative movement therebetween causing a sequential severing of the plurality of connectors.

* * * * *